US005372270A

United States Patent [19]

Rosenkrantz

[11] Patent Number: 5,372,270

[45] Date of Patent: Dec. 13, 1994

[54] SHOE SEAL FOR FLOATING ROOF

[75] Inventor: David J. Rosenkrantz, Emmaus, Pa.

[73] Assignee: Allentech, Inc., Northampton, Pa.

[21] Appl. No.: 56,405

[22] Filed: May 4, 1993

[51] Int. Cl.[5] ..... B65D 88/46

[52] U.S. Cl. ..... 220/224; 220/221; 220/226

[58] Field of Search ..... 220/216, 218, 221, 224, 220/222, 226

[56] References Cited

U.S. PATENT DOCUMENTS

| | | | |
|---|---|---|---|
| 1,493,174 | 5/1924 | Wiggins . | |
| 1,574,011 | 2/1926 | Wiggins . | |
| 1,662,225 | 3/1928 | Wiggins . | |
| 1,673,984 | 6/1928 | Kuhl . | |
| 1,801,582 | 4/1931 | Wiggins . | |
| 2,576,136 | 11/1951 | Moyer | 220/224 |
| 2,669,372 | 2/1954 | Allen et al. | 220/224 |
| 2,685,982 | 8/1954 | Moyer | 220/224 |
| 2,803,371 | 8/1957 | Edens . | |
| 2,888,161 | 5/1959 | Springer | 220/224 |
| 2,897,998 | 8/1959 | Ulm | 220/224 |
| 2,960,252 | 11/1960 | Ulm . | |
| 3,589,549 | 6/1971 | Heisterberg | 220/222 |
| 3,618,812 | 11/1971 | Maeder | 220/222 X |
| 4,036,395 | 7/1977 | Tuckey | 220/224 |
| 4,287,999 | 9/1981 | Heisterberg | 220/222 |
| 4,540,104 | 9/1985 | Kawai et al. . | |
| 5,036,995 | 8/1991 | Wagoner . | |
| 5,078,293 | 1/1992 | Lippiello . | |

FOREIGN PATENT DOCUMENTS

| | | |
|---|---|---|
| 751359 | 6/1956 | United Kingdom . |
| 1250081 | 10/1971 | United Kingdom . |
| 2146379 | 4/1985 | United Kingdom . |

*Primary Examiner*—Allan N. Shoap
*Assistant Examiner*—Vanessa Caretto
*Attorney, Agent, or Firm*—Foley & Lardner

[57] ABSTRACT

A shoe seal for effecting a vapor barrier between a lightweight internal floating roof and a tank wall of a tank includes a plurality of shoe sections; a plurality of hanger brackets connected to perimeter sections of the lightweight internal floating roof; a plurality of braces connected to corresponding hanger brackets and the floating roof for supporting the hanger brackets; a plurality of pivoting support arms pivotally connected to corresponding hanger brackets and to corresponding upper portions of the shoe sections; a plurality of biasing members connected to the internal floating roof and to lower portions of the shoe sections; and a vapor barrier fabric connected between the shoe sections and the floating roof.

18 Claims, 4 Drawing Sheets

SHOE SEAL FOR FLOATING ROOF

BACKGROUND OF THE INVENTION

The present invention relates to shoe seals for sealing the space between an internal floating roof and an inner tank wall of a storage tank.

Bulk fluids such as petroleum and fuel products are usually stored in large cylindrical tanks. These tanks are commonly designed with internal floating roofs or covers to minimize product losses to the atmosphere. A critical part of the internal floating roof is the sealing mechanism that is installed in the annular space (rim space), between the internal floating roof and the inner wall of the storage tank. This sealing mechanism is designed to allow the internal roof to float on the stored product, to maintain a vapor seal, to move easily within the tank as the product level rises and falls, and to keep the floating roof centered within the storage tank.

It is known to use floating roofs made of steel. Steel floating roofs are structurally strong and are designed to have a large amount of buoyancy. Therefore, when designing sealing mechanisms for steel floating roofs, the forces exerted by the sealing mechanism on the steel roof and the weight of the sealing mechanism have not been problems, because of the relatively large strength and buoyancy of steel roofs.

However, there are several disadvantages with steel roofs. Compared to lightweight internal floating roofs, such as those made from aluminum, steel roofs are expensive to install and maintain. The large weight of steel roofs requires that, for installation, a hole be cut in the side of an existing storage tank for moving the heavy steel roof materials into the interior of the tank. After the steel roof is installed and the hole is patched, the tank must then be hydrostatically tested. A major problem with hydrostatic testing is disposal of the water used in hydrostatically testing the tank. In the face of present strict environmental regulations, it is often very expensive to dispose of the test water which is contaminated with a small percentage of a stored product.

Therefore, it has been found more economical to use lightweight floating roofs, such as aluminum floating roofs. The materials used in aluminum floating roofs are small and lightweight enough to be transported to the interior of the storage tank through an existing manhole in the tank shell, rather than by cutting a hole in the side of the tank. Because of their light weight, aluminum floating roofs require less buoyancy. The cost of labor and materials to install an aluminum internal floating roof is less than that for a steel floating roof, and the maintenance cost for an aluminum floating roof is lower than that for a steel roof. Aluminum floating roofs typically float on pontoons secured to their underside and have the advantages of simple construction and low cost.

A major disadvantage of lightweight roofs is that they cannot support much weight because of the nature of their construction. The comparatively weak strength and weight-bearing capacity of lightweight roofs limits the type of seals which can be used with such lightweight roofs to those which are of relatively simple construction, and particularly those which are light in weight.

In the past, a typical seal for such a lightweight roof would consist of a single flexible wiper blade mounted on the outer rim of the roof and extending into contact with the inner tank wall. The wiper blades were made from a variety of materials, depending upon the product being stored. The single flexible wiper blades are of limited effectiveness in providing a seal and, furthermore, tend to deteriorate rather rapidly, therefore requiring a frequent inspection cycle. In an effort to provide more complete and effective sealing of lightweight floating roofs, various secondary seals have been tried. The presence of such secondary seals enhances the sealing action, but usually at the expense of reduced storage capacity, added weight and complexity. A further problem with the wiper blade type of seal is that no elastomeric material has been found which is resistant to attack from all the various products which are stored in the storage tanks. Therefore, depending on the product stored, the wiper blade type seal must be changed to a wiper blade made from a material which is resistant to attack from the product being stored.

Shoe-type seals typically provide adequate sealing action without the need for a secondary seal. Shoe-type seals can be made of stainless steel, and therefore can be used with any type of product in the storage tank. Shoe seals are heavier than wiper blade type seals and exert more force on the internal floating roof which supports them. Floating roofs made of steel are adequate to support shoe-type seals because of the steel roof's strength and large buoyancy. However, when installing conventional type shoe seals on lightweight internal floating roofs, problems arise due to the inability of the lightweight roof to support the weight of the shoe seal and to absorb the forces generated by the sealing action of the shoe seal.

U.S. Pat. No. 5,078,293 discloses a shoe seal for a lightweight floating roof. The '293 device includes hollow floats which are submerged in the product stored in the tank and provide an upward force on a lever bracket which is attached to the shoe sections. The upward force generated by the buoyant member changes in proportion to the density of the product stored. It is evident that the '293 device does not address the important geometrical property of the maximum angle that the shoe bracket makes with the vertical. It is also evident that the friction on the tank shell is proportional to the pressure applied by the shoe and the pressure applied by the shoe is proportional to the upward force from the buoyant member. Therefore, if the product stored in the tank changes such that a significant increase in product density occurs, the friction force between the shoe and the tank shell could increase dramatically, and, combined with unsuitable bracket geometry, could bind and overcome the flotation available. In such a case, the effectiveness of the entire floating roof would be compromised.

SUMMARY OF THE INVENTION

It is an object of the present invention to provide a shoe-type seal which solves the above-discussed problems of the prior art.

It is another object of the invention to provide a shoe-type seal for a lightweight internal floating roof which provides an effective sealing mechanism.

It is still another object of the present invention to provide a shoe-type seal which is simple to manufacture and easy to install.

It is yet a further object of the present invention to provide a shoe-type seal which can be easily retrofitted on existing steel or aluminum roofs.

It is still a further object of the present invention to provide a shoe-type seal which is compatible for use with any type of product being stored.

The foregoing objects are achieved by a shoe seal for effecting a vapor barrier between a lightweight internal floating roof and a tank wall of a tank, the shoe seal including a plurality of shoe sections each having upper and lower portions; a plurality of hanger brackets connected to perimeter sections of the lightweight internal floating roof; a plurality of braces having first ends connected to corresponding hanger brackets and second ends connected to the floating roof for supporting the hanger brackets; a plurality of pivoting support arms having first ends pivotally connected to corresponding hanger brackets and second ends pivotally connected to corresponding upper portions of the shoe sections; a plurality of biasing members connected at first ends to the internal floating roof and connected at second ends to corresponding lower portions of the shoe sections; and a vapor barrier fabric, a first end of the vapor barrier fabric being connected to the internal floating roof and a second end of the vapor barrier fabric being connected to the upper portions of the shoe sections such that a vapor seal is made between the shoe sections and the floating roof; wherein the upper portions of the shoe sections are maintained in contact with an inner side of the tank wall by pivoting action of the pivoting support arms; and wherein the lower portions of the shoe sections are maintained against the inner side of the tank wall by the plurality of biasing members.

Other objects, features, and advantages of the present invention will become apparent from the following detailed description taken in conjunction with the accompanying figures.

BRIEF DESCRIPTION OF THE DRAWINGS

The drawings are hereby expressly made a part of the specification.

DETAILED DESCRIPTION OF THE PREFERRED EMBODIMENTS

The present invention solves the problem of prior art seals by providing a shoe seal which can be used with any type of product in the storage tank. The shoe seal is also usable with lightweight internal floating roofs which are low in buoyancy and structural strength. The shoe seal provides a simple and inexpensive way of sealing lightweight internal roofs that are used with any product.

Figure 1:
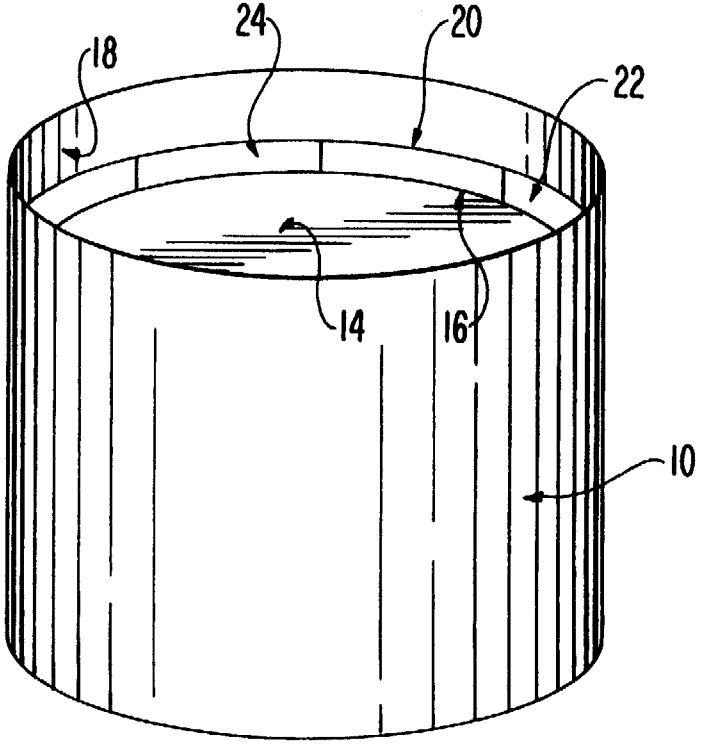
FIG. 1 is a perspective view of a storage tank having a lightweight floating roof and a shoe seal in accordance with the invention.

FIG. 1 shows a typical storage tank 10. A floating roof 14 floats on top of a liquid product such as oil, stored within the tank 10.

To prevent hydrocarbon vapors from escaping into the atmosphere from the space between the perimeter section 16 of the floating roof 14 and an inner tank wall 18, a seal 20 is provided. The seal 20 extends between the perimeter section 16 of the floating roof 14 and the inner tank wall 18 around a circumference of the floating roof 14, and acts as a barrier to hydrocarbon or other vapors. The seal 20 is capable of movement up and down the tank wall 18 while maintaining a sealing relationship therewith, so that the floating roof 14 may rise or fall with the varying quantities of the liquid product in the tank 10.

The floating roof 14 is of the lightweight type frequently used in enclosed storage tanks. Such lightweight floating roofs are typically of aluminum construction, are supported by pontoons attached to the underside thereof, and float on a surface of the liquid product in the storage tank.

As described in detail hereafter, the seal 20 is of the shoe type in which a series of shoe sections or metal plates 24 are joined together and extend around the circumference of the lightweight floating roof 14, forming a shoe 22 which is mounted on the perimeter section 16 of the lightweight floating roof 14. Shoe seals in accordance with the present invention utilize pivoting support arms to maintain contact between the upper portion of the shoe sections and the inner side of the tank wall, and biasing members to maintain contact between lower portions of the shoe sections and the inner side of the tank wall.

Figure 2:
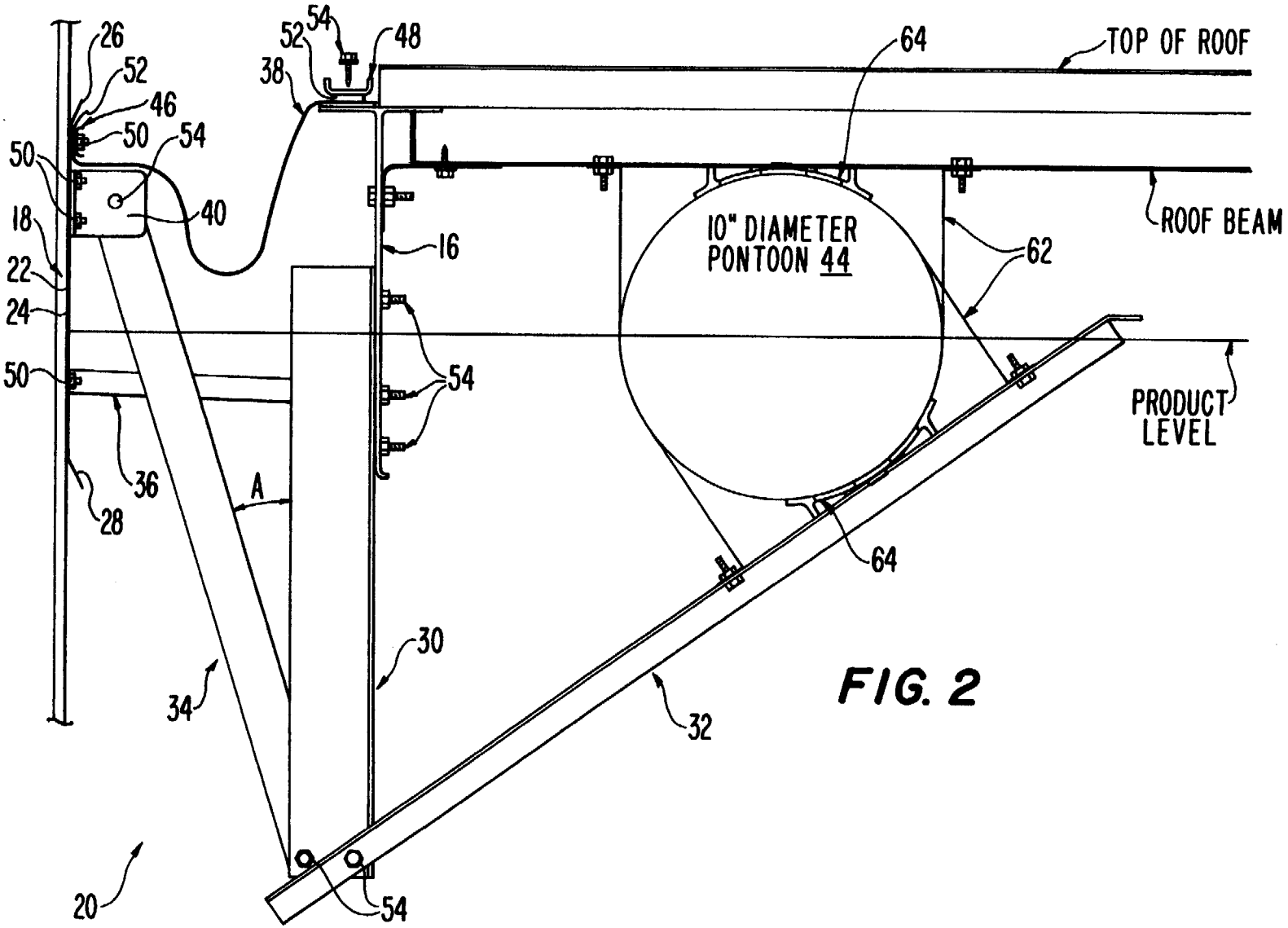
FIG. 2 is a side view of the shoe seal of the present invention.
Figure 3:
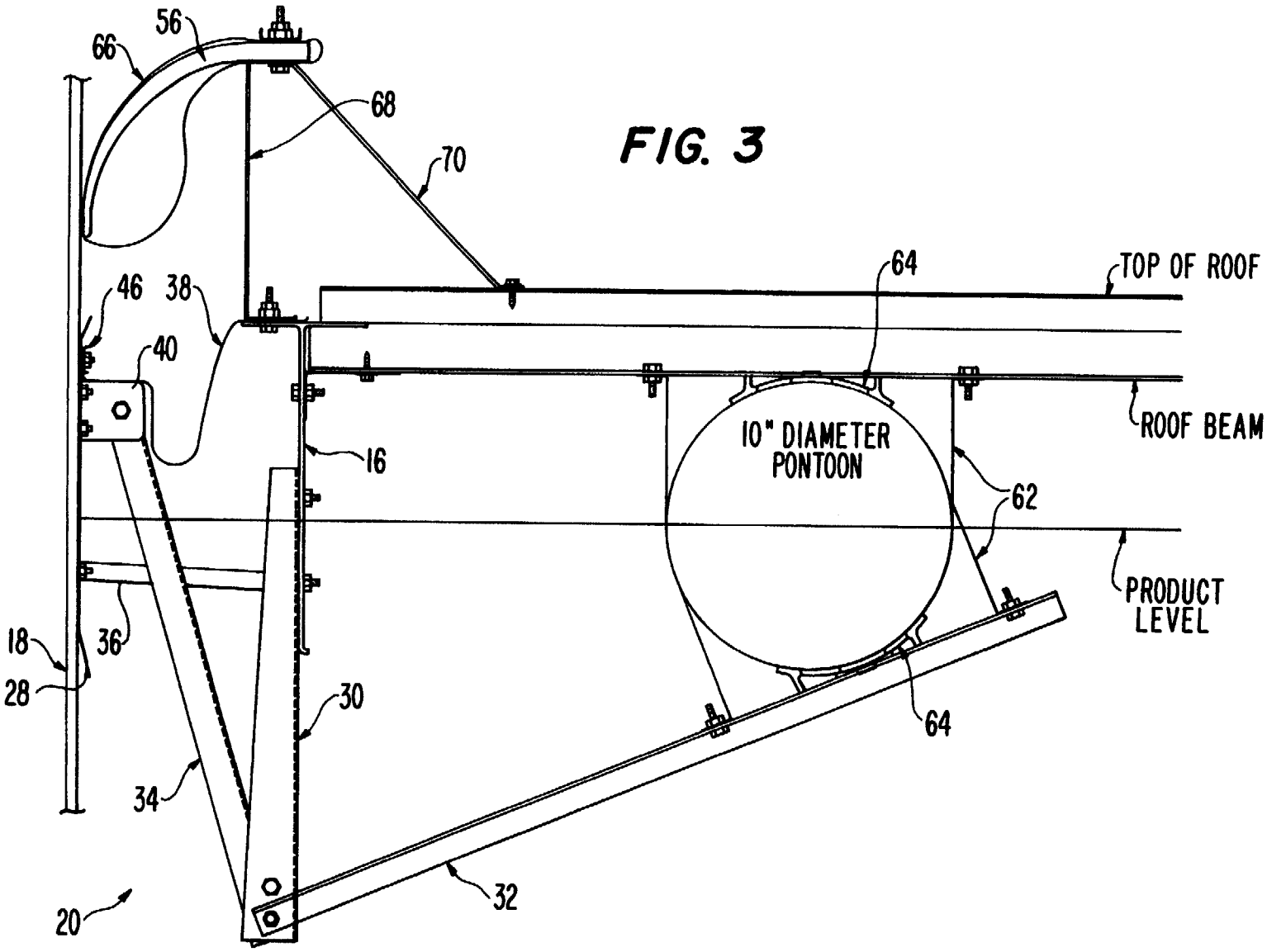
FIG. 3 is a side view of the shoe seal of the present invention including a secondary seal.

FIGS. 2 and 3 show the seal 20 in detail. The seal 20 includes a shoe 22 which is composed of a series or plurality of shoe sections or metal plates 24 which have an inwardly extending upper lip 26 along an upper edge thereof, and inwardly extending opposite lower lip 28 along a lower edge thereof. The upper and lower lips 26 and 28, respectively, facilitate upward and downward movement of the shoe sections 24 along the inner tank wall 18. The storage tank 10 can be either of the riveted type or of the welded type. In the case of a riveted tank, the metal plates forming the tank are joined together by rivets, the heads of which protrude from the inner tank wall 18. The shoe 22 can be designed to slide over the rivets of such tanks. In the case of welded storage tanks, the metal plates comprising the tank are welded together. In that event, the shoe 22 is capable of sliding over the inner tank wall 18, including the butt- or lap-welded seams of the wall.

A plurality of shoe sections 24 are disposed around the periphery of the tank wall 18 and are frictionally engaged with the wall 18. Shoe sections 24 may be made of metal or other suitable flexible material that is non-reactive with the storage contents. In the preferred embodiment, shoe sections 24 are made of 18 gauge 304 stainless steel. A preferred size for a shoe section is about 12 inches wide and 6 feet, 4 inches long. To form the inwardly extending upper and lower lips 26, 28, upper and lower sections of the shoe section about 1 inch wide are bent to approximately 32 degrees from the vertical. Additionally, a series of slots are formed in the upper and lower lips 26, 28 to allow for close conformity to shell irregularities. The slots are about 1/32 of an inch wide and about 1-inch deep and spaced apart about 6 inches.

The shoe sections 24 are designed to overlap 1 inch, with the overlap varying plus or minus ½ inch according to tank irregularities. The shoe-to-shoe joint requires no gasket. This design eliminates expansion joint fabric and fasteners, thereby simplifying the construction and assembly time, and eliminating the problem of degradation of the fabric due to contact with the product.

The upper portions of the shoe sections 24 are maintained in contact with the inner tank wall 18 by the pivoting action of the pivoting support arms 34. The pivoting support arms 34 are connected to the upper portion of the shoe sections 24, preferably by pivot angles 40.

The pivot angles 40 are formed from a flat plate which is bent to form approximately a right angle. One section of the pivot angle 40 is bolted to the shoe section 24 and another section of the pivot angle 40 is bolted to the support arm 34.

The lower ends of the support arms 34 are pivotally connected to hanger brackets 30. The hanger brackets 30 are connected to the perimeter sections 16 of the lightweight internal floating roof 14. The hanger brackets 30 are essential because in many lightweight internal floating roofs, the perimeter sections 16 do not extend vertically downward far enough so that the support arm 34 can be attached to the perimeter section 16. Therefore, in a preferred embodiment, the hanger brackets 30 are connected to bottom portions of the perimeter section 16 for extending the bottom portions vertically downward thereby allowing the support arms 34 to be connected to the hanger brackets 30 at a lower point.

The hanger brackets 30 are also necessary from the point of view of the geometry of the shoe 22. Years of experience in repairing shoe seals have resulted in a finding that some failures can be attributed to lack of attention to the geometry of the shoe support arm assembly. Designs that allow the support arm 34 to reach more than 30 or 35 degrees from the vertical can bind and fail. Aluminum internal floating roofs in particular have little capacity for resisting the forces generated when the support arms 34 go past 30 or 35 degrees. Therefore, as shown in FIG. 2, the angle A is preferably a maximum of 35 degrees and, more preferably a maximum of 30 degrees.

The bottom of the hanger bracket 30 is supported by a brace 32 which has one end connected to the hanger bracket 30 and the other end connected to the internal floating roof 14. Where the internal floating roof 14 has a structural member sufficiently close to the hanger bracket 30, the brace 32 is attached directly to the structural member of the floating roof 14. In floating roofs where there are no structural members close to the perimeter 16 of the floating roof, it may be necessary to install a plurality of pontoons 44 arranged circumferentially around the internal roof 14. The pontoons are hollow aluminum cylinders with a diameter of, for example, 10 inches. The pontoons 44 can be attached to the internal floating roof 14 in a number of ways. One way of attachment shown in FIGS. 2 and 3 is by using pontoon straps 62 and pontoon saddles 64. Where pontoons 44 are used, the braces 32 are connected directly to the pontoons 44.

Preferably the pivot angles 40, hanger brackets 30, braces 32, and support arms 34 are made of aluminum or an aluminum alloy. If necessary, these components may also be made of stainless steel or other non-reactive materials.

Figure 4:
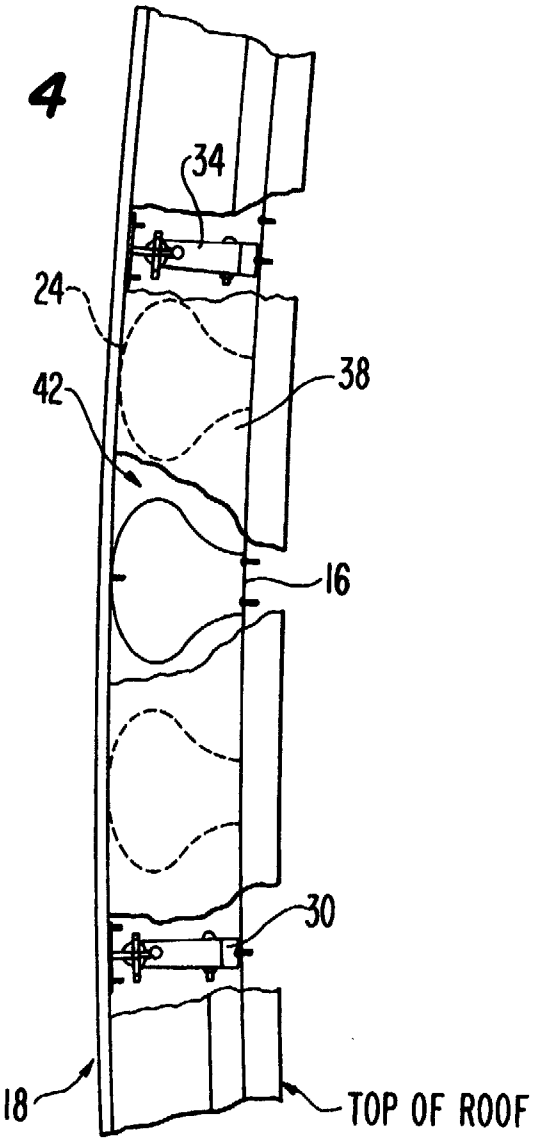
FIG. 4 is a fragmentary top view of the shoe seal showing the hoop spring.

The lower portions of the shoe sections 24 are maintained against the inner tank wall 18 by a plurality of biasing members 36. The biasing members 36 are connected between lower portions of the shoe sections 24 and the perimeter section 16 of the floating roof 14. As shown in FIG. 4, a preferred embodiment of the biasing member 36 is a hoop spring 42. The hoop spring 42 is preferably made of stainless steel. The hoop spring 42 may be fabricated from 0.030-inch thick spring tempered full hard 302 stainless steel. Advantageously, the hoop spring 42 is fabricated from a strip of stainless steel about 44 inches long. Five holes are drilled in the strip, two holes near each end and one hole in the center. The two ends are then bent at 90 degrees to the rest of the strip. The strip is then bent into a circle and the 90 degree portions overlapped and bolted to the perimeter section 16 of the floating roof. The other end is bolted to the lower portion of the shoe section 24.

While FIG. 4 shows one hoop spring 42 (solid line), it is to be understood that the number of hoop springs 42 used will depend on the length of the shoe section 24. In a preferred embodiment, three hoop springs 42 are used for each shoe section 24. As shown by broken lines in FIG. 4, two additional hoop springs are provided, one on either side of the cutaway portion of the fabric 38.

As shown in FIG. 4, the portions of the hoop springs 42 adjacent the shoe sections 24 deform horizontally and press against the shoe section 24 in a relatively long horizontal line, thereby distributing the force against the shoe section 24 more uniformly than prior art designs. This uniform pressure allows the shoe section 24 to conform closely to any shell irregularities. Furthermore, because the pressure is applied across a larger area, the hoop springs 42 help prevent the seal 20 from binding as it moves upward and downward in the tank. On the other hand, where the biasing pressure is applied at a single point as in prior devices, the probability of binding is greater.

A vapor barrier fabric 38 has one end connected to the internal floating roof 14 and the other end connected to the upper portion of the shoe section 24 such that a vapor seal is made between the shoe section 24 and the floating roof 14. The vapor barrier fabric 38 can be made from a wide variety of materials, for example, teflon for chemical and temperature resistance, or urethane for use in gasoline tanks. The fabric can be as thin as 10 mils or as thick as 40 mils. The specific width of the fabric serves to limit the outward motion of the shoe to the maximum safe excursion distance. The vapor barrier fabric 38 is connected to the internal floating roof 14 by a perimeter fabric clamp 48 and to the shoe section 24 by a shoe fabric clamp 46. Gaskets 52 are preferably inserted between the clamps 46, 48 and their respective mounting surfaces. The gaskets are conveniently made of surlyn.

Figure 5:
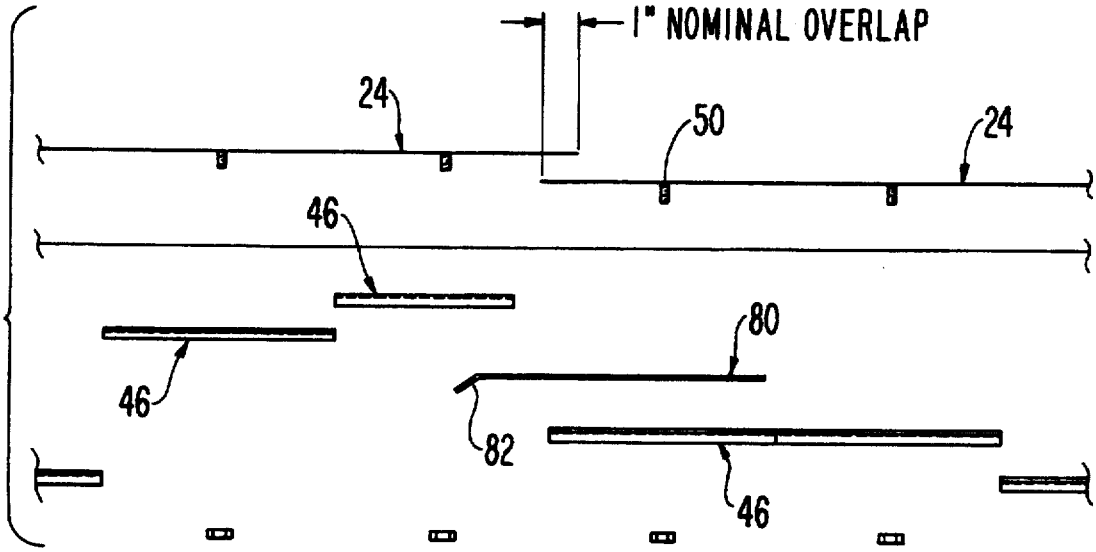
FIG. 5 is a top exploded view showing a joint strap.
Figure 6:
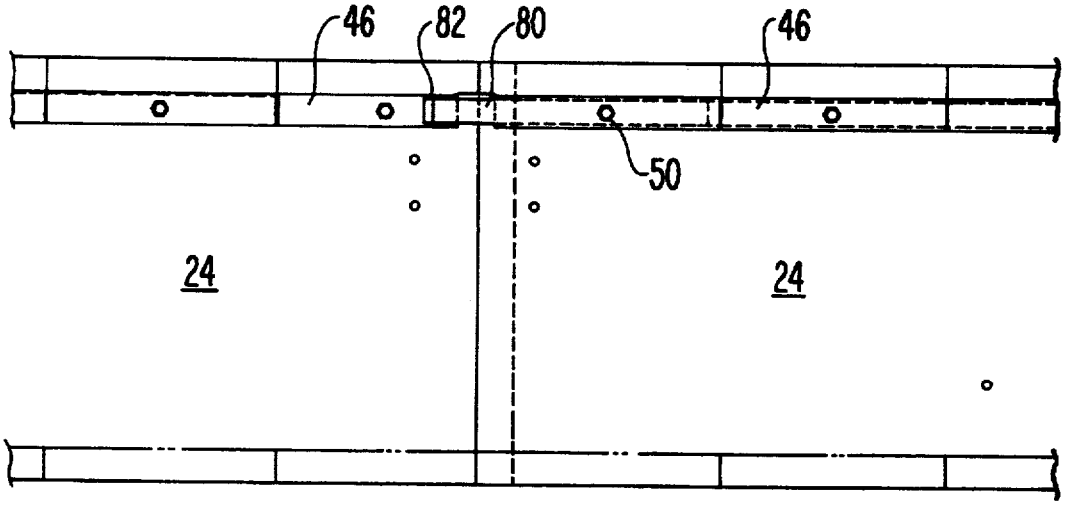
FIG. 6 is a front view of FIG. 5.

As shown in FIGS. 5 and 6, where the shoe sections 24 overlap, it is convenient to provide a short metal joint strap 80 which spans the overlap and helps to keep the fabric 38 close to the shoe sections 24, thereby minimizing leakage at the overlap. The joint strap 80 is fixedly attached to only one shoe section 24 (the right-hand one in FIGS. 5 and 6), so that it may adjust as the amount of overlap between the shoe sections 24 changes. The joint strap 80 is made from 0.030 inch 302 spring tempered full hard stainless steel, or other suitable material. The joint strap 80 is fabricated from a flat bar and is drilled with a hole to be fitted over a stud 50 on the shoe section 24. The free end 82 of the joint strap 80 is formed with a slight inward bend to facilitate sliding of the joint strap. As shown in FIGS. 2 and 3, the biasing member 36 is preferably connected to the roof 14 and the shoe section 24 such that the product level in the tank is above the biasing member 36. It is preferable to locate the biasing members 36 below the product level because then the biasing members 36 can safely conduct static electricity through the product rather than through the vapor above the product level. Static electricity is generated in the storage tanks, and the biasing members 36 serve to safely drain the static electricity to the inner tank wall 18.

The shoe sections 24 are preferably formed with welded on stainless steel studs 50 for attachment of the biasing members 36, pivot angles 40, and fabric clamps 46.

The vapor barrier fabric 38 is arranged to be above the product level in the tank. This minimizes the degradation of the vapor barrier fabric 38, because exposure to the product liquid is more harmful than exposure to the product vapor.

The seal 20 includes fasteners 54 between the braces 32 and hanger brackets 30, the hanger brackets 30 and the support arms 34, the support arms 34 and the pivot angles 40, the hanger brackets 30 and the perimeter section 16, and the braces 32 and the roof 14. Preferably, the fasteners 54 are made of stainless steel.

As shown in FIG. 3, a secondary seal 56 may be installed above the shoe seal 20 for further improving the vapor barrier efficiency. The secondary seal 56 may be made of an open cell urethane foam and surrounded by a hypalon fabric 66. The secondary seal 56 is supported on the internal floating roof 14 by a secondary seal riser 68 and a secondary seal riser brace 70. It is, of course, possible to use other arrangements for supporting a secondary seal 56.

The parts of the seal 20 of the present invention are individually small, easy to manufacture, and tolerant of relatively large errors in manufacture or installation. In addition, use of the studs 50 to bolt the shoe sections 24 to the support arms 34 and fabric clamps 46 eliminates points of corrosion, the problem of accurate hole sizing and placement requirements, and possible loose or missing fasteners. The seal 20 arrives in the field with the support arms 34, hanger brackets 30, and pivot angles 40 in pre-assembled units, all fasteners 54 associated with the shoe 22 already part of the shoe 22, and all gaskets 52 pre-assembled to their clamps 46, 48 in pairs. In addition, because the gaskets 52 are located above the vapor barrier fabric 38, the gaskets' exposure to product vapors is minimized. This is an important factor in the ability of the seal 20 to last a long time in a variety of products.

The standard shoe seal 20 can be adapted to work on most lightweight internal floating roofs by adjusting the size of the hanger bracket 30 and the hole pattern and by adapting the brace 32 to attach to whatever structure is available. The shoe seal 20 can also be fabricated from all steel components for use on steel floating roofs.

Generally, the annular space between the inner tank wall 18 and the perimeter section 16 of the roof 14 is from 6–10 inches. The shoe seal 20 is designed to have about 4 inches of horizontal play in either direction from the nominal middle position.

Each shoe section 24 is preferably supported by two pivot angles 40 attached to the shoe section 24 and pinned to two support arms 34, which are in turn supported by two hangar brackets 30. Each hangar bracket 30 is supported by a brace 32. Each shoe section 24 is preferably pressed uniformly against the tank wall by three equally spaced biasing members 36.

The present invention has been described above in relation to certain preferred embodiments. However, many modifications, alterations, and changes are possible to the described embodiments without departing from the spirit and scope of the invention as defined in the appended claims, and equivalents thereof.

What is claimed is:

1. A shoe seal for effecting a vapor barrier between a lightweight internal floating roof and a tank wall of a tank, comprising:

a plurality of shoe sections each having upper and lower portions;

a plurality of hanger brackets connected to bottom portions of perimeter sections of the lightweight internal floating roof, extending the bottom portions downward;

a plurality of braces having first ends fixedly and rigidly connected to corresponding hanger brackets at positions vertically below the internal floating roof, and second ends rigidly connected to the floating roof, for supporting the hanger brackets;

a plurality of pivoting support arms having first ends pivotally connected to corresponding hanger brackets at positions vertically below the internal floating roof and second ends pivotally connected to corresponding upper portions of the shoe sections;

a plurality of hoop springs disposed substantially horizontally and connected at first ends to the internal floating roof and connected at second ends to corresponding lower portions of the shoe sections; and a vapor barrier fabric, a first end of the vapor barrier fabric being connected to the internal floating roof and a second end of the vapor barrier fabric being connected to the upper portions of the shoe sections such that a vapor seal is made between the shoe sections and the floating roof;

wherein the upper portions of the shoe sections are maintained in contact with an inner side of the tank wall by pivoting action of the pivoting support arms; and wherein the lower portions of the shoe sections are maintained against the inner side of the tank wall by the plurality of hoop springs.

2. The shoe seal of claim 1, further comprising a plurality of pivot angles connected to upper portions of the shoe seal sections and the second ends of the pivoting support arms for pivotally connecting the support arms to the shoe seal sections.

3. The shoe seal of claim 2, wherein the pivot angles, hanger brackets, braces, and support arms are made of a material selected from the group consisting of aluminum or aluminum alloy.

4. The shoe section of claim 2, further comprising shoe fabric clamps and perimeter fabric clamps for attaching the vapor barrier fabric to the shoe sections and the floating roof, respectively.

5. The shoe seal of claim 4, wherein the shoe seal sections further comprise studs made of the same material as the shoe seal sections for connecting the shoe fabric clamps, the biasing members, and the pivot angels to the shoe seal sections.

6. The shoe seal of claim 4, further comprising gaskets inserted beneath the shoe fabric clamps and perimeter fabric clamps wherein the clamps and the gaskets are located above the vapor seal thereby minimizing the gaskets' exposure to product vapors.

7. The shoe seal of claim 2, further comprising fasteners between the braces and the hanger brackets, the hanger brackets and the support arms, the support arms and the pivot angles, the hanger brackets and the perimeter sections of the roof, and the braces and the roof; wherein the fasteners are made of stainless steel.

8. The shoe seal of claim 1, wherein maximum angles between a vertical plane and the support arms are about 35 degrees.

9. The shoe seal of claim 8, wherein the maximum angles are about 30 degrees.

10. The shoe seal of claim 1, wherein the floating roof includes a plurality of pontoons arranged circumferentially around the roof and wherein the second ends of the braces are connected to the pontoons.

11. The shoe seal of claim 1, wherein the lightweight internal floating roof is made of a material selected from the group consisting of aluminum or aluminum alloy.

12. The shoe seal of claim 1, wherein the shoe sections are made of stainless steel.

13. The shoe seal of claim 1, wherein the hoop springs are made of stainless steel.

14. The shoe seal of claim 1, wherein the hoop springs are connected to the roof and the shoe sections such that a level of product in the tank is above the hoop springs, whereby the hoop springs safely conduct static electricity through the product rather than through a vapor above the product level.

15. The shoe seal of claim 1, wherein the shoe sections overlap about one inch at shoe section joints thereby eliminating a need for gaskets, expansion joint fabric, and fasteners at the joints.

16. The shoe seal of claim 1, further comprising a plurality of joint straps wherein each joint strap spans an overlap between adjacent shoe sections and helps to keep the vapor barrier fabric close to the adjacent shoe sections, thereby minimizing leakage of product vapor at the overlap.

17. The shoe seal of claim 1, wherein the vapor barrier fabric is arranged above a product level in the tank.

18. The shoe seal of claim 1, further comprising a secondary seal located above the vapor barrier fabric and attached to the internal floating roof.

* * * * *